United States Patent [19]

Fitz

[11] Patent Number: 4,721,459

[45] Date of Patent: Jan. 26, 1988

[54] MODULAR, INSULATING KILN CAR TOP

[75] Inventor: Albert E. Fitz, Philo, Ohio

[73] Assignee: Ferro Corporation, Cleveland, Ohio

[21] Appl. No.: 880,599

[22] Filed: Jun. 30, 1986

[51] Int. Cl.[4] ..... F27B 9/26; F27D 1/12

[52] U.S. Cl. ..... 432/241; 432/253; 432/258

[58] Field of Search ..... 432/241, 253, 258, 259

[56] References Cited

U.S. PATENT DOCUMENTS

| | | | |
|---|---|---|---|
| 1,521,216 | 12/1974 | Dressler | 432/241 |
| 1,587,210 | 6/1926 | Beecher et al. | 432/241 |
| 1,694,749 | 12/1928 | Moore et al. | 432/241 |
| 1,739,176 | 12/1929 | Morris et al. | 432/253 |
| 1,908,186 | 5/1933 | Robertson | 432/241 |
| 3,759,661 | 9/1973 | Bansby | 432/241 |
| 4,462,798 | 7/1984 | Foster | 432/241 |
| 4,578,031 | 3/1986 | Johnson et al. | 432/241 |

*Primary Examiner*—Henry C. Yuen

*Attorney, Agent, or Firm*—George W. Moxon, II

[57] ABSTRACT

There is disclosed a refractory, insulating assembly for preventing kiln car heat loss, said assembly consisting of dome-shaped, hollow modular members disposed in a row along each running edge of said kiln car, with the space therebetween covered with a layer of insulating refractory.

7 Claims, 9 Drawing Figures

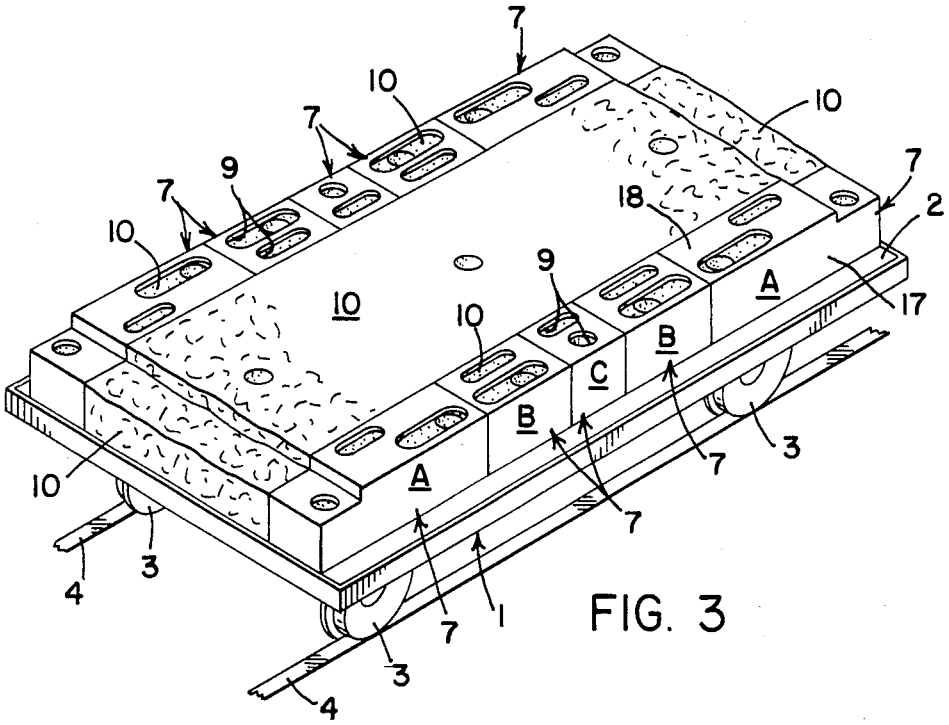
FIG. 3
FIG. 4
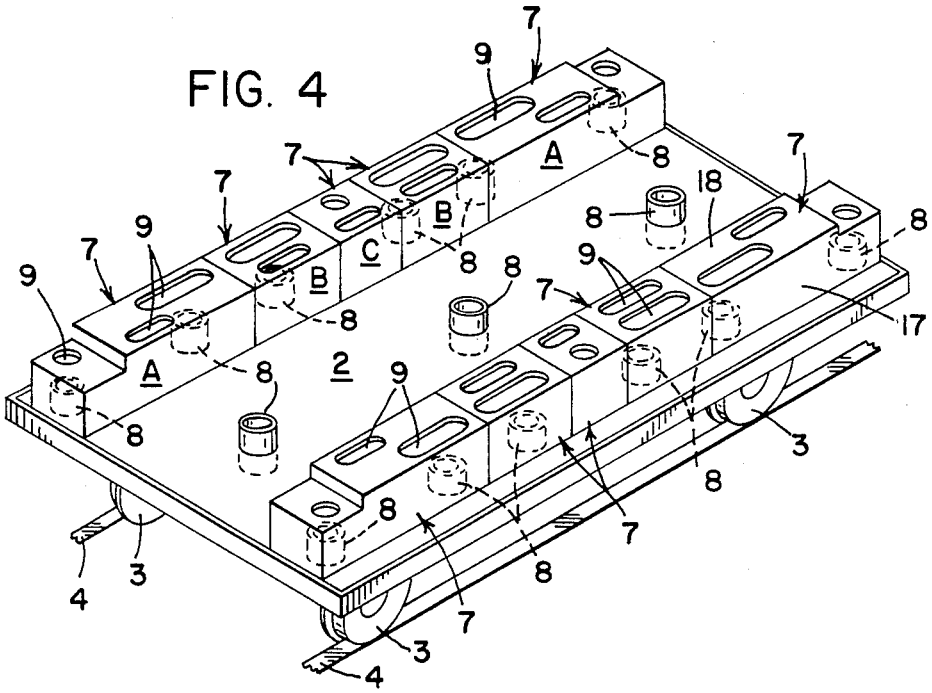

MODULAR, INSULATING KILN CAR TOP

SUMMARY AND BACKGROUND OF THE INVENTION

Kiln cars are well-known in the art and have been described in some detail in countless prior publications and patents. For example, see U.S. Pat. Nos. 1,739,176, 1,846,614, 1,908,186 and 3,094,759. The cars typically are used to transport ceramic ware through long kilns for the purpose of firing the ware, either for bisque or glost firing, at elevated temperatures, usually well in excess of 1500° F. Usually, the cars have conventional, flanged running gear for track transport, and are slowly pushed through a long cavernous tunnel kiln in end-to-end, abutted relationship. The chassis of the cars is normally of heavy gauge, welded sheet steel, and to protect that steel, running gear, etc., and to minimize heat loss from the kiln, the cars have traditionally been topped with any number of ceramic refractory layers. See the U.S. Patents referred to above.

However, with the premium currently placed on energy conservation, it has been found that the massive, solid refractory covers and supports used heretofore for protecting the top of the kiln car and for supporting ceramic ware to be fired thereon, are exceedingly wasteful of energy in two major respects.

First, in order to stabilize the firing cycle within the kiln, the massive refractory structures used heretofore literally had to be heated to essentially the same temperature as the temperature at which the ware it carried was being fired. Secondly, because of the solid, dense structure of kiln car tops used heretofore, those tops became heat conductors during the firing cycle through the tunnel kiln, and literally transmitted the heat away from where it was needed most, i.e. from the upper levels where the supported ware to be fired was situated, down through the massive supporting, solid refractory to the bottom, metal chassis and running gear of the kiln car.

The instant invention essentially eliminates extensive heat loss through the kiln car top by providing a highly insulating cover for the kiln car, which transmits relatively little heat away from the kiln atmosphere and furthermore, because of its relatively light-weight structure, does not rob the kiln of any appreciable amount of heat, thereby enhancing heat stabilization within the kiln. That is, because the kiln car top of this invention does not function as a heat sink for robbing the kiln interior of heat, the stability of the ambient temperature within the kiln is materially improved, in that cold spots are all but removed in the hot zone, and temperature gradients from top to bottom, and from side to side, are materially reduced.

The means for achieving the insulated kiln car top of this invention, stated in simplest terms, is the utilization of a series of modular, inverted, cup-shaped refractory members in a row along two opposed edges of the kiln car supporting surface. When the cars are in abutted, operational, tunnel-kiln relationship, these members essentially form a continuous pair of side rails, along a pair of opposed linear edges, of a tunnel kiln car train. Being of hollow, relatively thin, refractory material, the modular members aforesaid may be filled with conventional, refractory insulating material. The space between the two insulating, retaining walls or rails aforesaid, may then be loosely, though optimally, packed with conventional refractory, insulating fiber up to a height roughly coincident with the tops of the inverted, cup-shaped members aforesaid, to thereby provide an insulating kiln car top which serves to prevent any substantial heat loss from the kiln ambience down through to the kiln car chassis. By "optimally" packed fibrous insulation, is meant that it is packed in such a way as to provide maximum heat insulation; that is, too densely, or too loosely, packed insulation reduces its insulating value.

By "modular" is meant a certain degree of interchangeability or flexibility, whereby, for example, end member "A" of FIG. 4 may be used on the rectangular surface of any kiln car, regardless of its length (or width). The same applies to intermediate modules "B" of FIG. 4. Then, for larger, or shorter, kiln cars, only center module "C" would have to be specially tooled for a given size car, for a particular kiln. It being well known that cars designed for a given kiln are of uniform dimensions.

Although not essential to the practice of the instant invention, and as will be disclosed in more detail hereinafter, a relatively thin, light-weight, refractory post and plate arrangement may be utilized in conjunction with the instant invention, whereby the posts may extend down to, or through, the insulating modular members to the kiln car supporting surface, which ultimately carries the load of the ware in spaced-above position with respect to the insulated kiln car top.

As will be readily apparent, the instant invention is equally applicable to either tunnel kiln, or shuttle kiln, cars with but minor modification. That is, for tunnel kiln application, since the cars are inside the kiln in a relatively long train, in end-to-end snugly abutting relationship with respect to each other, the modular members of this invention are placed along each of a pair of opposed edges of the car, parallel to its axis of travel. However, this invention also contemplates that the modular members could also be arranged along the front and back edges of the car, in a second pair of opposed rows, normal to the axis of travel, if desired. Thus, a tunnel kiln car may optionally have said modular members disposed around the entire periphery of its top, or just along the two edges parallel to its line of travel.

If the kiln car is to be used in a shuttle kiln, wherein only one or two kiln cars will be in the kiln at a time, on a periodic basis, then the modular members of this invention would normally be disposed in two sets of opposed rows, essentially conforming to the kiln car top periphery, in order to provide complete heat protection.

The essence of this invention then, resides in at least two rows of the modular members of this invention, disposed across from each other, along a pair of opposed edges of a kiln car top. The space between the two rows of modular members will have at least a layer of refractory insulation on the kiln car top, and the modular members may optionally contain refractory insulation material.

Reference to Drawings

FIG. 1 is a side, sectionalized elevation view of a standard kiln car chassis, having flanged wheels designed to engage, and be guided through the kiln by, conventional rail means. Shown on said kiln car depicted in FIG. 1, in partial cut-away view, is one version of the modular insulating top of the present invention; and FIG. 2 is a perspective, exploded view of one method of utilizing the modular members of the instant invention; and FIG. 3 demonstrates a slight variation of the car top depicted in FIG. 2; and FIG. 4 is a perspective view of a kiln car top with just the insulating members of the present invention in place; and FIG. 5 is a plan view of the modular components of FIG. 4 in place; and FIG. 6 is a perspective view of one of the intermediate modules of FIG. 5; and FIG. 7 is a section of the module depicted in FIG. 6, taken along the line 7—7 thereof; and FIG. 8 is a perspective view of an end module depicted in FIG. 5; and FIG. 9 is a section of the module depicted in FIG. 8, taken along the line 9—9 thereof.

DETAILED DESCRIPTION OF THE INVENTION

The first step in preparing the conventional metal kiln car supporting surface for the modular members of this invention, is to cover it with a relatively thin layer of light-weight, conventional refractory. This may take the form of an air-drying castable, which will form a protective layer over the kiln car metal chassis, or it may be made up of relatively thin, refractory slabs cemented together at their joints.

Figure 1:
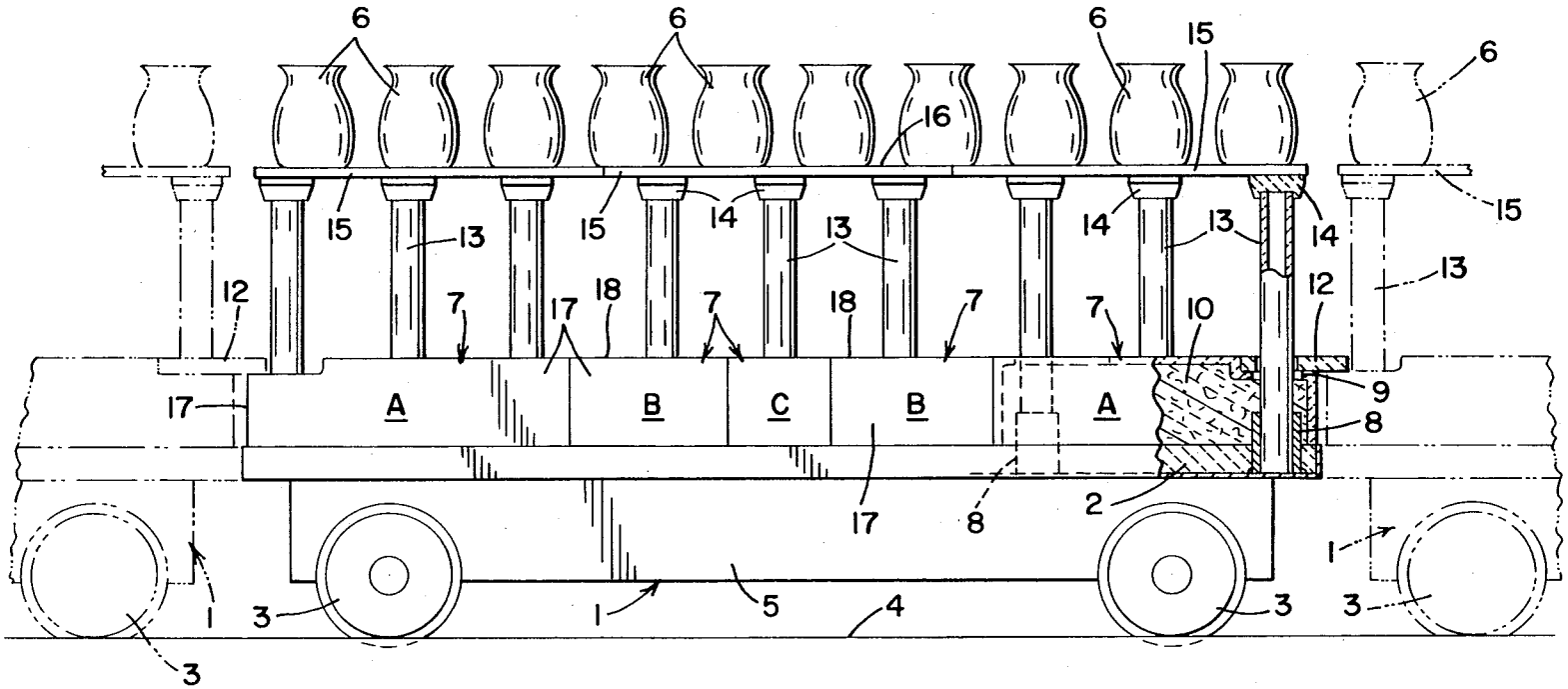

Referring now to FIG. 1, the kiln car chassis is generally represented by reference numeral 1, and the thin refractory layer covering the metal chassis of the kiln car is designated by 2.

Reference numeral 3 designates the flanged running gear for moving the kiln car on rail 4. The sheet steel chassis of the kiln car is designated generally by 5, while 6 indicates the ceramic ware, in this case, vases, to be supported by the kiln car during firing.

Figure 5:
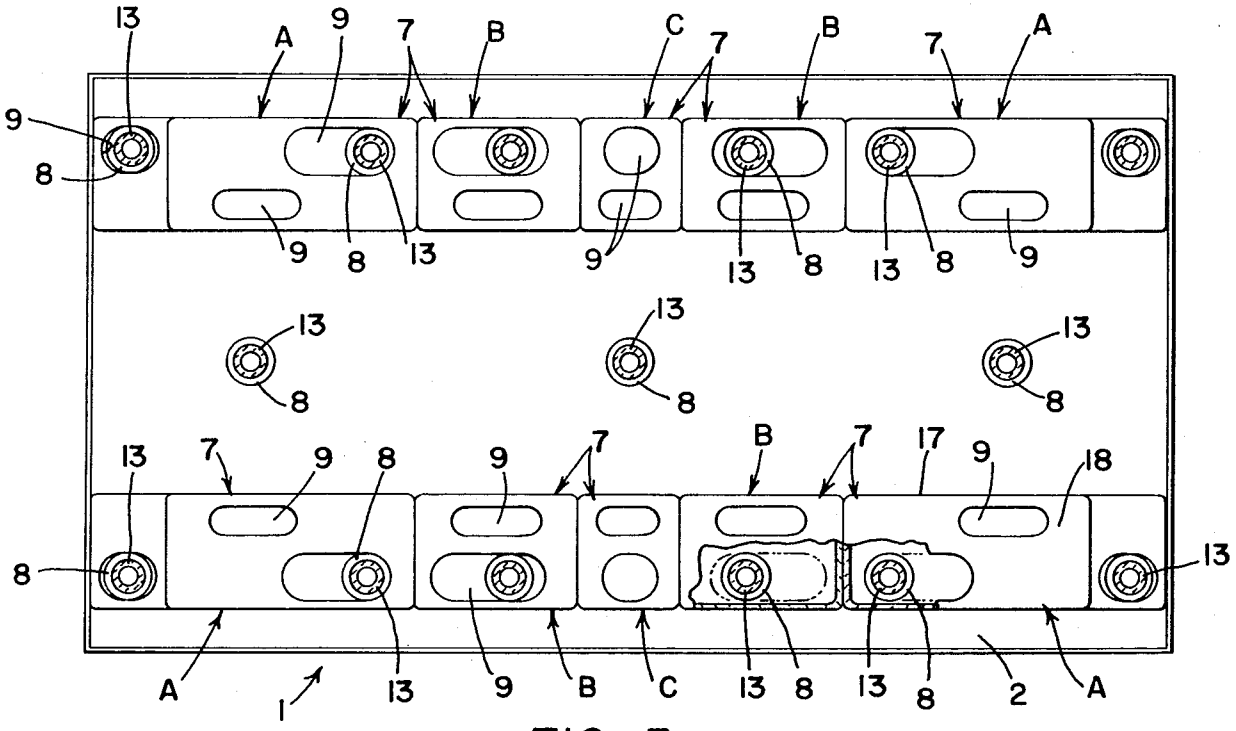
Figure 6:
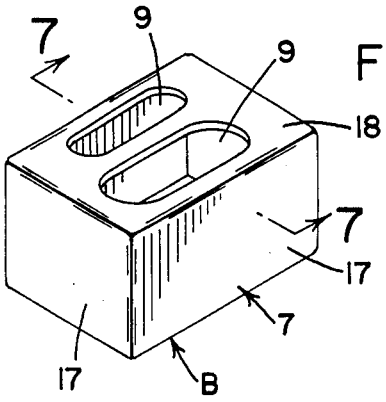
Figure 7:
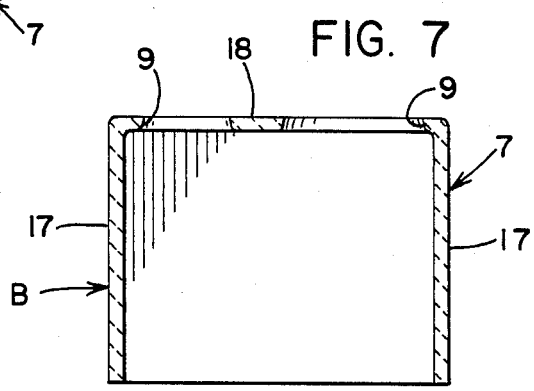
Figure 8:
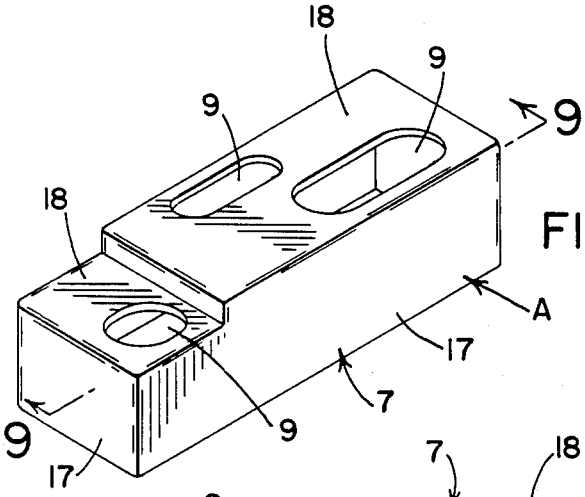
Figure 9:
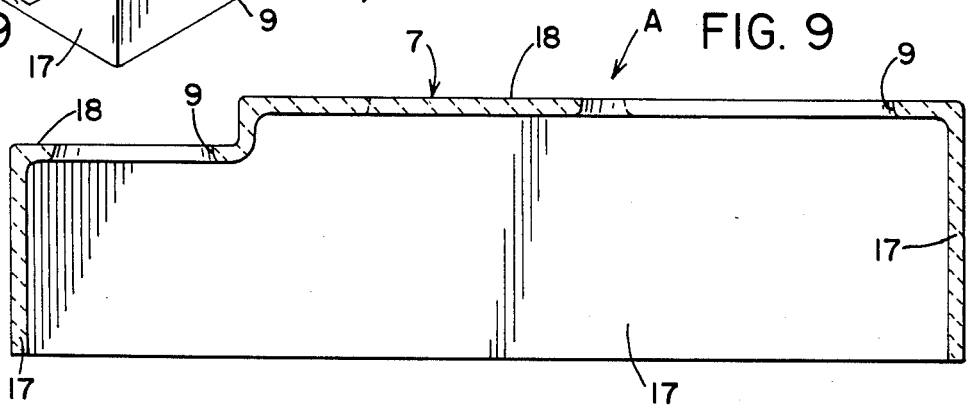

The composite kiln car depicted in FIG. 1 is more readily understood, at this juncture, by reference to FIGS. 4 and 5, which represent the first step in building up the insulating assembly of the instant invention. First, the dome-shaped modular members of the instant invention, which are essentially the hollowed, inverted, refractory shapes depicted in FIGS. 6–9 inclusive, are arranged along each running edge of the kiln car as shown, the modules being represented generally by the reference numeral 7. In this particular embodiment, the three modules shown are more specifically represented by stepped, end modules "A", intermediate modules "B", and center module "C". Note that tubular, steel sleeves 8 have been welded to the steel frame of the car, and extend up through protective slab 2. From FIG. 5 it will be noted that oblong and circular openings 9, in the tops of the dome-shaped modules, are positioned to vertically coincide with said sleeves along the edge of said kiln car. In the embodiment shown, these openings are either circular or oblong.

Purely for purposes of illustration, the modules have not been placed at the very edge of the kiln car, but in actual practice they would be placed as close to the edge of the kiln car as possible, consistent with any internal, kiln overhang which might partially protect the car edges.

The hollow, dome-shaped modules 7 are slip cast of a suitable refractory, using well-known, conventional manufacturing procedures, though they could be formed by any acceptable process known in the art.

After the modules are arranged on a given kiln car protective slab 2 as shown in FIGS. 4 and 5, conventional fibrous insulating refractory 10, such as "Inswool Ceramic Fiber", manufactured by the A. P. Green Refractories Company, may be manually stuffed, and optimally packed into the modules, through any one of the top apertures in the hollow, refractory modules as shown in FIG. 3. While all the modules depicted contain at least two openings, which are either circular or oblong, it is only required that there be at least a single such opening in the module tops, large enough to permit manual stuffing of the fibrous refractory material aforesaid. However, though it wouldn't be quite so convenient, the dome-shaped members could be cast without any apertures, and the fibrous insulation stuffed into them through their open bottoms, before inverting and placement on the kiln car. Lastly, the lateral space between the aligned dome-shaped members, which are snugly abutted against each other, is optimally packed with the same fibrous insulating refractory, to a height roughly coincident with the height of the modular members, as shown in FIG. 3.

It can readily be envisioned, from FIG. 3, that a train of such kiln cars, in tight, end-to-end, abutting relationship, would then have continuous retaining walls running along each side of its length, composed of the modular members of the instant invention, each filled with fibrous, insulating refractory, each row of modular members acting as a retaining wall to hold between the two said rows, optimally packed fibrous refractory material. Because of the fluffy nature of insulation 10, it may be worked in such a way as to intermingle with that of an abutting car, to protect the car ends.

However, the intermediate structure depicted in FIG. 3 may be refined to prevent dusting of insulating fiberglass, and to better protect the abutting ends of tunnel kiln cars.

Figure 2:
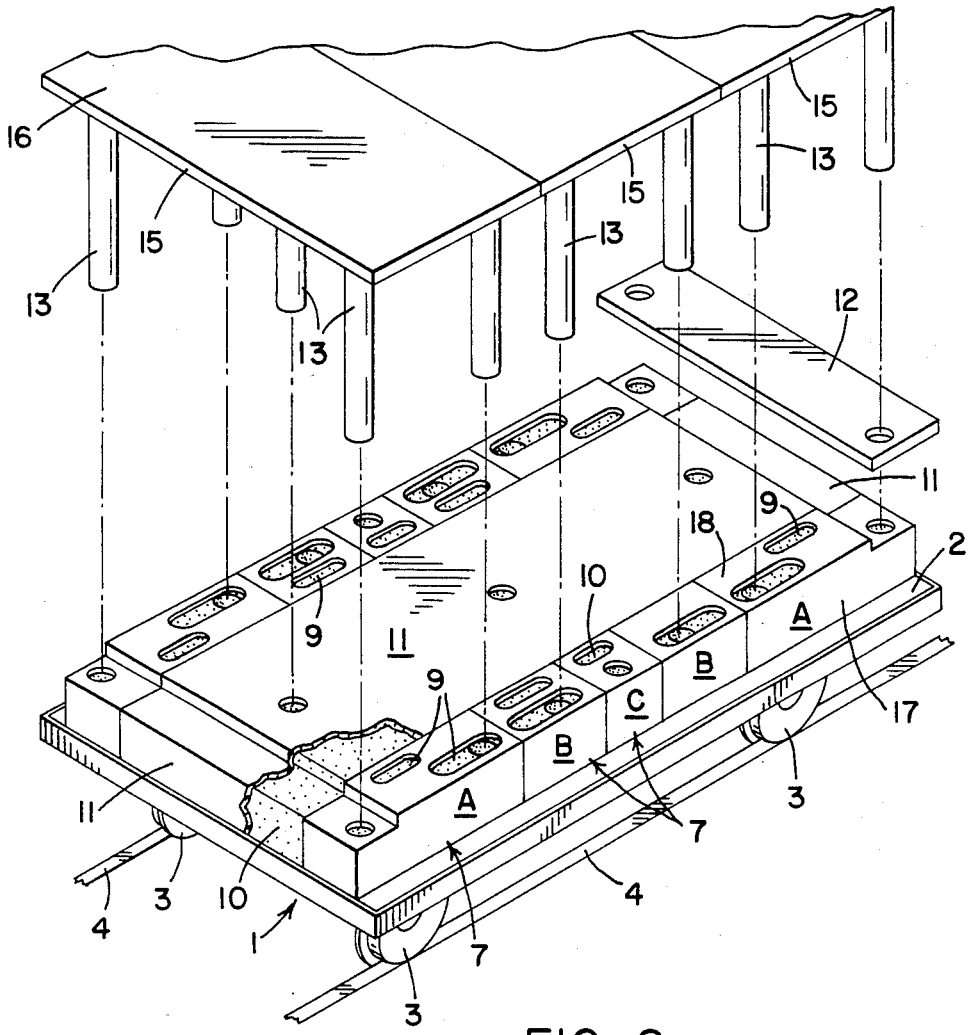

Refer now to FIG. 2, wherein it will be seen that fibrous insulation 10 has been covered with relatively thin, pressed, refractory fiberboard, such as Inswool Ceramic Fiberboard, manufactured and supplied by the A. P. Green Refractories Company. Although the joints between the various pieces of fiberboard are only shown schematically, their sizing and placement would be a matter of choice to effectively cover the loose fiber between the two rows of modules, the fiberboard covering being designated generally by the reference numeral 11. In conjunction with this particular embodiment, to further protect car ends, an end overlapping board 12 would be employed whereby the abutting end of the preceding car, would be slightly overlapped, thereby providing a positive heat shield over the abutting ends of a pair of kiln cars.

With continuing reference now to FIGS. 1 and 2, particularly FIG. 2 for a ready understanding of the next sequential step, tubular, refractory support posts 13 may now be passed through circular or oblong openings 9 in the tops of the modular members, to be engaged, and held firmly in vertical position, by metal, tubular sleeves 8. As shown in FIG. 1, the posts 13 may be topped with a cap or capital 14, which in turn supports lightweight slabs or beams of fired refractory 15, which in turn provide ware bearing surfaces 16, on which the ceramic ware to be fired, 6, may be stacked.

While the preferred embodiment shown utilizes columns or posts 13 by passing same through appropriate openings in the top of the dome-shaped modules, some or all of said columns could pass down through loose refractory fibrous material into appropriately positioned sleeves or sockets 8, in which case the top, outer surfaces of the domed members would have optionally no openings therethrough communicating with the inner cavity thereof.

While the preferred embodiment shown utilizes modular dome-shaped members having relatively flat, vertical sides, which are pressed into relatively snug, heat-insulating abutting relationship, it is contemplated that any number of conventional, additional heat loss features may be incorporated without departing from the spirit of the invention.

For example, as will readily be inferred from the foregoing disclosure, the number of modules utilized to cover one edge of a given kiln car top is a matter of choice, and ease of manufacture. Furthermore, although the preferred embodiment shows stepped-down end modules "A", in FIG. 8, the end module could also have an essentially straight top as either the center or intermediate modules.

Furthermore, these modules could incorporate, in their abutting faces, any number of tongue-and-groove features, either vertical or horizontal, whereby heat loss would be further discouraged. Also, although the vertical sides of the modules disclosed are essentially flat and smooth, it is within the contemplation of this invention that any number of interlocking features between abutting faces could be employed, such as either stepped or angular, vertical or horizontal, overlap.

The essence of this invention being a modular, dome-shaped, hollow refractory member, adaptable to be aligned in abutting relationship with other compatible modular members along the generally longer running edge of a kiln car, each said member having a top surface identifying an outer, upper surface of said member, and each said member having an inner cavity, the top surface of each said member preferably (though not necessarily) having at least one generally circular or oval opening therein communicating with said inner cavity, said opening of a size sufficient to permit manual, optimal, stuffing of refractory fibrous insulation into said member following its positioning on said kiln car. Said members, when in abutting relationship, forming two continuous rows along either edge of a train of kiln cars, adaptable to hold between them, optimally packed fibrous insulation, of a depth generally coincident with the tops of the modular members aforesaid.

DEFINITIONS AND ALTERNATE EMBODIMENTS

As used throughout the specification and claims, "dome-shaped" as applied to the modular members depicted in the drawings, is intended to define any such members having a top surface, and generally vertical, supporting side walls. While the modules of the instant invention have been disclosed as having generally four supporting side walls 17, and relatively flat top surfaces 18, the number of side walls is not critical, the same beneficial result could be achieved with fewer, or more, side walls, and the top surface, or surfaces, need not necessarily be flat. See FIGS. 6–9. It is also to be understood that it is within the comtemplated scope of this invention that dome-shaped end members "A", could be formed into hollow "L" shapes, whereby their respective legs would abut at the front and rear ends of the kiln car support surface, to provide full, peripheral protection.

By "heat-insulating, abutting relationship" is meant that adjacent members fit snugly and relatively tightly together, either directly, or through the use of a joining agent. For example, it is not practical to attempt to manufacture slip cast, fired refractory pieces with machine shop precision. Even if such precision could be accomplished, kiln car support tops are such that they will likely vary slightly from one to another in length, or width, or both. Therefore, it is conceivable that, in order to effectively protect the kiln car support surface, gaps of a quarter inch or more may occur between adjacent members. If this should happen, the gap may be readily filled with a castable cement, or strips of insulating "paper", fiberboard, or whatever. Regardless, either direct abuttment between members, or the use of an insulating material to bridge any gap occurring between them, effectively constitutes "heat-insulating, abutting relationship".

As used in an alternate embodiment described hereinafter, "tubular, hollow refractory members" refer essentially to the dome-shaped members of the preferred embodiment, but without a top surface.

Although tubular members of a circular cross section would likely not be extremely efficient, they could nevertheless conceivably be employed as an alternative embodiment of this invention. Preferably they would have the rectangular cross section of the dome-shaped members depicted in the drawings.

Although the preferred embodiment contemplates filling the refractory members with insulating material, they could conceivably be used without insulating material particularly if there were no openings in their tops. Obviously, if tubular members were utilized, they would require a layer of insulating material in their respective cavities, in order to protect the kiln car support surface.

Again, as with the dome-shaped members, tubular members could be utilized in conjunction with insulating fiberboard for the purpose of containing loose insulation material and for added, insulation protection.

Furthermore, while the preferred embodiment utilizes fibrous refractory insulation for filling the space between two rows of modular members, and for filling the modular members, any relatively lightweight, refractory material would suffice. Exemplary of such interchangeable refractory material would be vermiculite; pelletized diatomaceous earth; ground and sized insulating brick particles, etc. Nor is it essential that the space between the modular members of this invention be filled with the same insulation material inserted into the modular members themselves.

Finally, while the above preferred embodiment employs, in the top surface of the members, circular or oblong openings, the configuration of the opening is not critical, unless a support column or post 13 is going to pass therethrough, in which case the opening should conform snugly to the cross sectional shape of the support post, whatever that might be.

I claim:

1. In combination, a kiln car having a chassis which provides a support surface, a non-loadbearing, heat-insulated car top assembly, and a post means extending down to said support surface of said kiln car for carrying a load of ware in spaced-above position with respect to said car top assembly, said non-loadbearing, heat-insulated car top assembly comprising at least two spacedapart, generally parallel rows each of a multiplicity of modular, relatively thin, hollow refractory members aligned along opposite edges of an essentially rectangular support surface of said car, said post means passing through said modular members and being supported by sleeve means inside of said members which sleeve means receive said post means, said modular members, in a given row, disposed in heat-insulating, abutting relationship with each other, each of said members having a top, outer outer side surfaces and containing an insulating amount of refractory insulation, all said surfaces embracing an inner cavity, said top, outer surface of at least four of said members having at least one opening therein communicating with said inner cavity, with the support surface of said car, between said spaced-apart, parallel rows of said refractory members, having dispersed thereover, a layer of insulating refractory.

2. The combination of claim 1, wherein all of said members have at least one of said openings in their upper surfaces, respectively.

3. The combination of claim 1, wherein there are two pair of spacedapart, generally parallel rows of said members, substantially conforming to the entire, outer periphery of said rectangular support surface of said car.

4. The assembly of claim 1, wherein the top surface of each member has at least two openings therein communicating with said inner cavity.

5. The assembly of claim 1, wherein the top surface of each said member has two openings therein communicating with said inner cavity, and said openings are either oblong or circular.

6. The continuation of claim 1, wherein said hollow refractory members are dome-shaped.

7. The combination of claim 1, wherein said hollow refractory members are tubular hollow refractory members.

* * * * *